US006756570B2

(12) United States Patent
Sauter

(10) Patent No.: US 6,756,570 B2
(45) Date of Patent: Jun. 29, 2004

(54) COLD START COOKING SYSTEM

(75) Inventor: Kenneth E. Sauter, Ooltewah, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/301,579

(22) Filed: Nov. 22, 2002

(65) Prior Publication Data

US 2004/0099656 A1 May 27, 2004

(51) Int. Cl.[7] ..... H05B 1/02

(52) U.S. Cl. ..... 219/492; 219/483; 219/486; 219/412; 219/494

(58) Field of Search ..... 219/492, 494, 219/483, 485, 486, 411–414; 99/325–333

(56) References Cited

U.S. PATENT DOCUMENTS 4,517,431 A * 5/1985 Ueda ..... 219/10.55 B
4,656,828 A * 4/1987 Bingley et al. ..... 60/203.1
4,757,181 A 7/1988 Sakamoto et al.
4,927,998 A 5/1990 Tamura et al.
5,428,206 A 6/1995 Uchida et al.
5,432,321 A 7/1995 Gerl
5,454,939 A * 10/1995 Meuche ..... 210/134
6,198,078 B1 * 3/2001 Wanat et al. ..... 219/492

* cited by examiner

*Primary Examiner*—Mark Paschall
(74) *Attorney, Agent, or Firm*—Diederiks & Whitelaw, PLC

(57) ABSTRACT

A control system for a cooking appliance enables a consumer to perform a complete cooking operation regardless of whether food is placed into an oven after a preheating operation or from a cold start. In general, under circumstances where the consumer does not intend to allow the oven to be properly preheated prior to inserting the food to be cooked therein, an initial programming operation is followed by an additional control sequence by the user to establish a cold start cooking operation wherein the lack of preheating is automatically compensated for, preferably by causing the oven to reach a peak temperature for the oven which is well above a temperature set by the user for the overall cooking operation. After the peak temperature is reached, the oven temperature is allowed to gradually reduce to the preprogrammed cooking temperature.

18 Claims, 3 Drawing Sheets

COLD START COOKING SYSTEM

BACKGROUND OF THE INVENTION

1. Field of the Invention

The present invention pertains to the art of cooking and, more particularly, to a control system for a cooking appliance which enables the appliance to be selectively operated in a cold start cooking mode.

2. Discussion of the Prior Art

Conventional cooking appliances generally perform cooking operations through radiant heat developed from bake and/or broil heating elements. Such types of cooking appliances can take various forms, mainly ranges and wall ovens. When utilizing a conventional cooking appliance, the oven is initially controlled to proceed through a preheat cycle in order to establish a desired cooking temperature. Oftentimes, a signal is provided to a user when the preheat cycle is complete in order to indicate when the food to be cooked can be placed in the oven. In some cases, both the bake and the broil elements are actuated during the preheat cycle. In addition, it is also known to incorporate an internal fan in an oven for more evenly distributing developed heat. Convection systems are actually quite prevalent in microwave and other types of ovens which do not require preheating. However, utilizing convection systems in cooking appliances employing bake and broil elements is also known.

Regardless of the type of overall heating system utilized, it is not uncommon for a consumer to place food into an oven for a predetermined cook time without first enabling the oven to reach a preheat temperature. Since cooking times set forth in recipes or other cooking instructions are established based on an oven being preheated, failure to preheat the oven directly affects the overall food preparation. Under such circumstances, the user must either mentally determine a supplemental cooking time period for the food item or, if the cook time is not altered, the food will be at least slightly undercooked.

Based on the above, there exists a need in the art for a system which will enable a consumer to readily alter an established cooking operation when it is known that an oven is not going to be allowed to reach a preheat temperature prior to placing food in the oven. In other words, under conditions wherein a cold start cooking operation is to be performed, it would be beneficial to enable the consumer to easily alter a programmed cooking operation to automatically compensate for the lack of a preheat cycle.

SUMMARY OF THE INVENTION

The present invention is directed to a control system for a cooking appliance which enables a consumer to perform a complete cooking operation regardless of whether food is placed into an oven after a preheating operation or from a cold start. In general, the invention enables a consumer to program a cooking appliance through a control panel in a conventional manner based on established cooking times and temperatures in accordance with recipes or other cooking instructions. However, under circumstances wherein the consumer does not intend to allow the oven to be properly preheated prior to inserting the food to be cooked therein, an additional control sequence can be performed by the user, such as the selection of a cold start feature. Thereafter, the control system for the cooking appliance will automatically alter the overall cooking operation to compensate for the lack of a preheat stage.

In accordance with the most preferred form of the invention, an additional button is provided on a programming pad of the control panel for the cooking appliance, wherein the consumer need only press the additional button when a cold start cooking operation is to be employed. In one embodiment, when a cold start cooking operation is selected, the control system of the cooking appliance establishes a peak temperature for the oven which is well above a temperature set by the user for the overall cooking operation. After the peak temperature is reached, the oven temperature is allowed to gradually reduce, with a lattermost portion of the established cooking time actually operating the oven at the preprogrammed cooking temperature.

Additional objects, features and advantages of the present nvention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
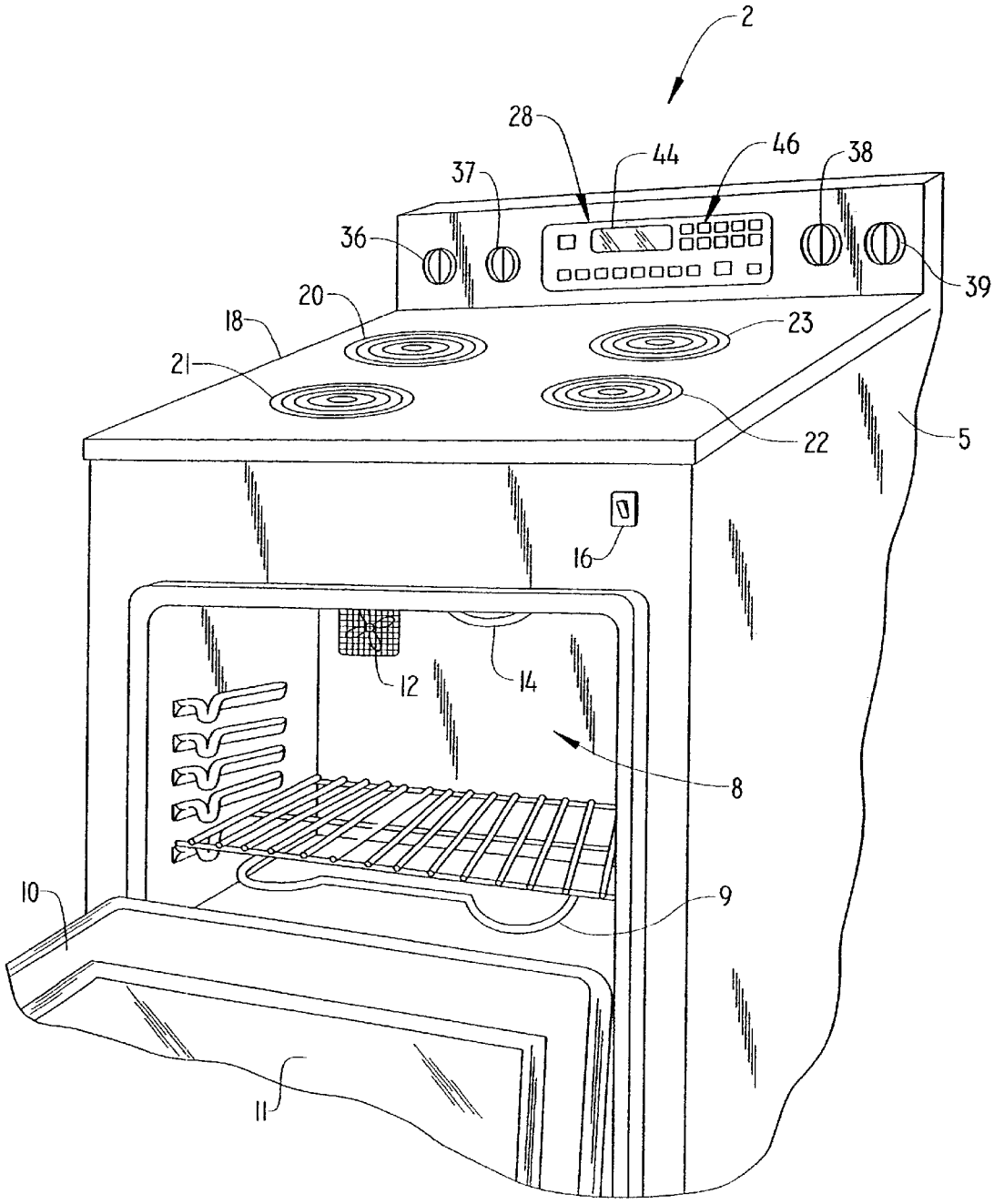
FIG. 1 is a partial perspective view of an electric range incorporating a cold start cooking system according to the invention.

With initial reference to FIG. 1, the invention is illustrated for use in connection with an electric range, generally indicated at 2. In the embodiment shown, electric range 2 includes a cabinet 5 within which is arranged an oven cavity 8 having an associated lower heating element 9 and a door 10, shown in an open condition wherein access to oven cavity 8 is permitted. The following description assumes that heating element 9 is of a conventional electric heating element design, but it is considered within the scope of this invention that heating element 9 may be a gas heating element or of any other conventional design. This figure also illustrates the presence of a viewing window 11 in door 10. Furthermore, within oven cavity 8, a fan 12 and an upper, broil heating element, a part of which is shown at 14, are provided. In a manner known in the art, cabinet 5 is provided with a light switch 16 which functions to turn on a light (not shown in FIG. 1 but indicated at 17 in FIG. 2) to illuminate oven cavity 8 upon the opening of door 10.

Cabinet 5 is also provided with an associated range top 18 which supports various spaced surface heating elements 20–23 in a manner known in the art. At an upper rear portion, cabinet 5 is provided with a control panel 28. Control panel 28 includes a plurality of knobs 36–39 for use in selectively activating and deactivating surface heating elements 20–23 respectively. In addition, control panel 28 is shown to include a central display 44, such as an LED or LCD display unit (also see FIG. 2). Furthermore, control panel 28 is provided with a number pad, generally indicated at 46, having buttons for the numbers zero (0) through nine (9), with the zero (0) button also functioning as a reset control button.

Although the particular features incorporated into electric range 2 could vary greatly within the scope of the present invention, for the sake of completeness in describing a preferred form of the invention, control panel 28 of range 2 is also shown to include a lower row of control buttons, generally indicated at 48, which are provided to select various operational modes for range 2. For instance, the row of control buttons 48 can be used to select bake, broil and clean modes for range 2 through respective buttons 49–51. In the particular embodiment shown, an additional convection baking mode, which is essentially defined by a baking mode with the further activation of fan 12, can also be selected through button 53.

In another form of the invention, the user may program the operation of range 2 through the use of the lower row of control buttons 48, control button 53 and numeric pad 46, as well as timer buttons 62 and 63. Furthermore, buttons 66 and 67 are provided to enable a consumer to set desired countdown and clock times, in combination with numeric pad 46, respectively. Button 68 performs a stop or clear control function, while button 69 enables a consumer to turn on light 17 without opening door 10 such that oven cavity 8 can be selectively viewed through window 11. Button 70 is provided to initiate the cold start function in accordance with this invention as will be described below. Finally, an Auto Set button 72 is provided and can be used to perform various programming functions as will also be discussed below. Of course, although various buttons are described for use on control panel 28, other types of control members, including a wide range of switches, could equally be employed. In addition, although the invention is being described with reference to range 2, it should be recognized that the invention is applicable to various types of cooking appliances, including wall ovens and the like.

Figure 2:
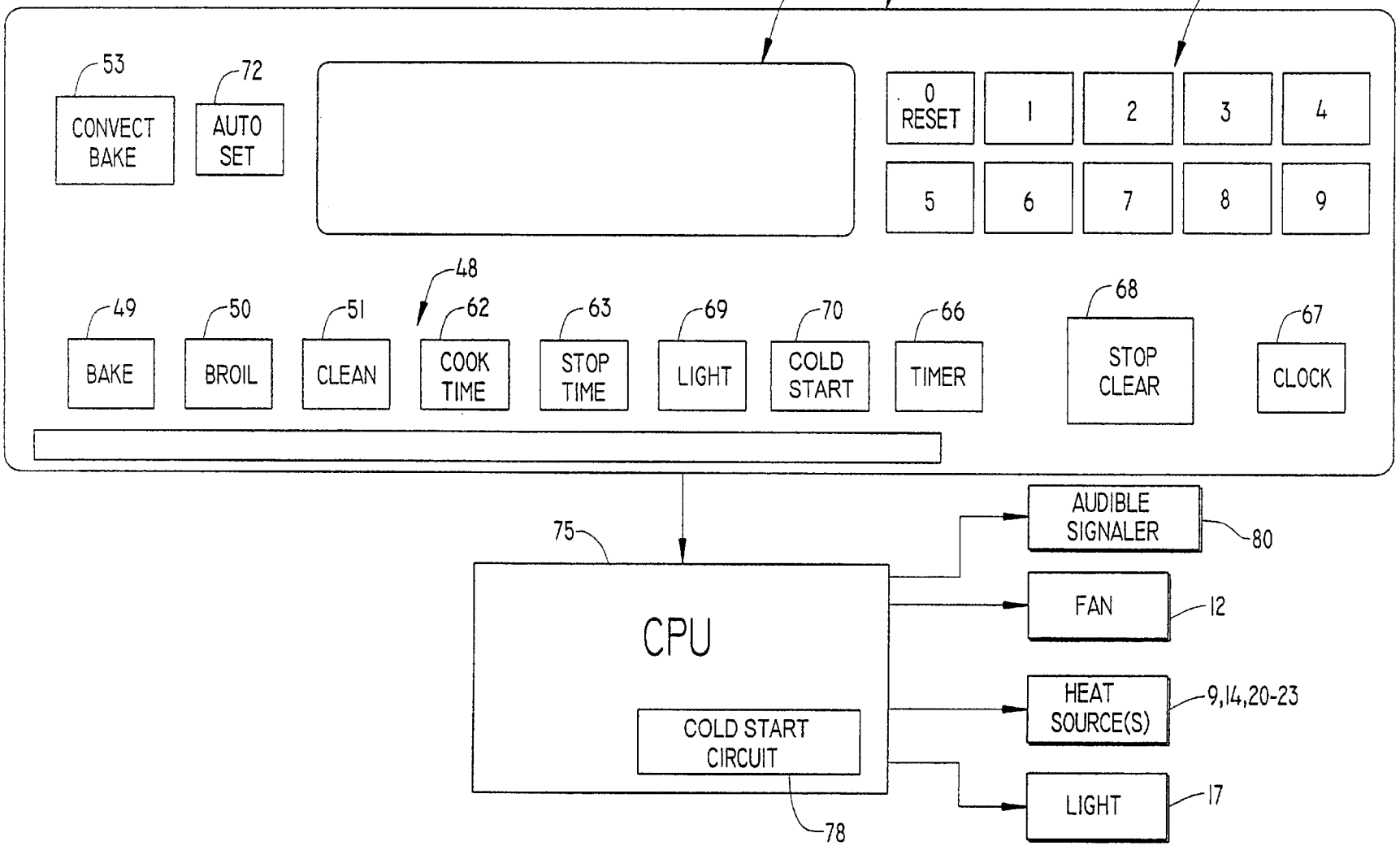
FIG. 2 is a front view of a control panel, forming part of the range shown in FIG. 1, including a schematic illustration of a control arrangement that forns part of the cold start cooking system.

FIG. 2 shows control panel 28 including an associated CPU 75 for controlling fan 12 and the heat sources of range 2, i.e., at least illustrated heating elements 9,14 and 20–23. CPU 75 also includes cold start circuit 78 which is activated through button 70 as will be more fully discussed below. The operation of light 17 and heating elements 20–23 is performed in a manner known in the art, does not constitute part of the present invention and therefore will not be discussed further here. However, it will be mentioned that Auto Set button 72 can be used to assist the user in programming a cooking operation for range 2. For example, if bake button 49 is selected, the operating temperature can be set directly through number pad 46 or by pressing Auto Set button 72 once for a certain starting temperature, e.g. 350° F. (177° C.), and subsequently for adding a set temperature value, e.g. 25° F., upon each further depression of button 72. If a broil operation is selected through button 50, Auto Set button 72 can be used to toggle between "Hi" and "Low" settings for heating element 14. In any event, this operation is known in the art and only provided for the sake of completeness. Instead, the present invention is particularly directed to the manner in which CPU 75 is programmed to cause heating of oven cavity 8 upon the selection of the cold start feature by a user through button 70. More particularly, cold start circuit 78 of CPU 75 operates in accordance with the present invention to assure that a complete cooking operation is performed on a food item placed within oven cavity 8 even though oven cavity 8 is not properly preheated.

In using range 2, a consumer may select a desired cooking function or operational mode through control buttons 49, 50 and 53, while also establishing an operating time period for the respective heat source utilizing numeric pad 46 and timer buttons 62 and 63. Again, numeric pad 46 or Auto Set button 72 can be used to set certain operating parameters as well. In one embodiment, the selected operation will be shown by illuminating key words or symbols in central display 44. The preceding description is similar to the structure described in U.S. Pat. No. 6,153,858, the entire disclosure of which is herein incorporated by reference.

It is preferable to employ some type of audible or visual indicator to the consumer when certain time periods have expired or certain temperatures have been reached. This function is performed by incorporating a piezoelectric buzzer or the like as indicated in FIG. 2 at 80. For instance, as with a conventional cooking appliance, buzzer 80 is preferably used to indicate the end of a cooking operation. In addition, when range 2 is used in a more conventional mode wherein oven cavity 8 is permitted to preheat prior to the placing of food therein for cooking, buzzer 80 can signal a user at the end of the preheat stage.

Of course, as indicated above, it is not uncommon for a consumer to place food into an oven for a predetermined cook time without first enabling the oven to reach a preheat temperature. Since cooking times set forth in recipes or other cooking instructions are established based on an oven being preheated, failure to preheat the oven directly affects the overall food preparation. However, in accordance with the present invention, the user need only press button 70 after programming a cooking operation wherein the user is not going to allow oven cavity 8 to preheat. Therefore, a signal is sent to CPU 75 that cold start circuit 78 is to be utilized in connection with the selected cooking operation. In general, when a cold start mode is selected, an actual cook time is calculated to arrive at an equivalent temperature and cook time associated with a preheat start. That is, cold start circuit 78 incorporates a control algorithm which functions to determine the required cold start time based on the cook time and temperature set by the user. This cold start time is then added to the cook time to arrive at an overall cooking operation time.

As an example, if biscuits are recommended to be cooked at 475° F. for 12 minutes and the cold start selector button 70 is pressed, CPU 75 would operate one or more of heat sources 9 and 14, perhaps even with fan 12, in a cold start mode for an extended period of time, such as 15 minutes. This additional time would compensate for the user placing the food in oven cavity 8 and initiating the cooking operation without allowing oven cavity 8 to reach its preheat temperature. Ultimately, the total cooking time is reduced by eliminating the preheat stage.

Certainly, there are various ways in which the invention can accomplish the goal of allowing a user to readily select a cold start is control feature, thereby establishing an intelligent, easy and efficient use of range 2. Of course, the actual preheat time for oven cavity 8 will be determined by the food load placed therein. That is, the more food placed in oven cavity 8, the longer a requisite preheat time. Correspondingly, when a cold start operation is selected, the amount of time added to the preprogrammed cooking time should effectively vary with the food load. In accordance with the most preferred form of the invention, the actual time added based on a cold start is established based on an integration of the area under a set temperature and above a preheat curve.

Figure 3:
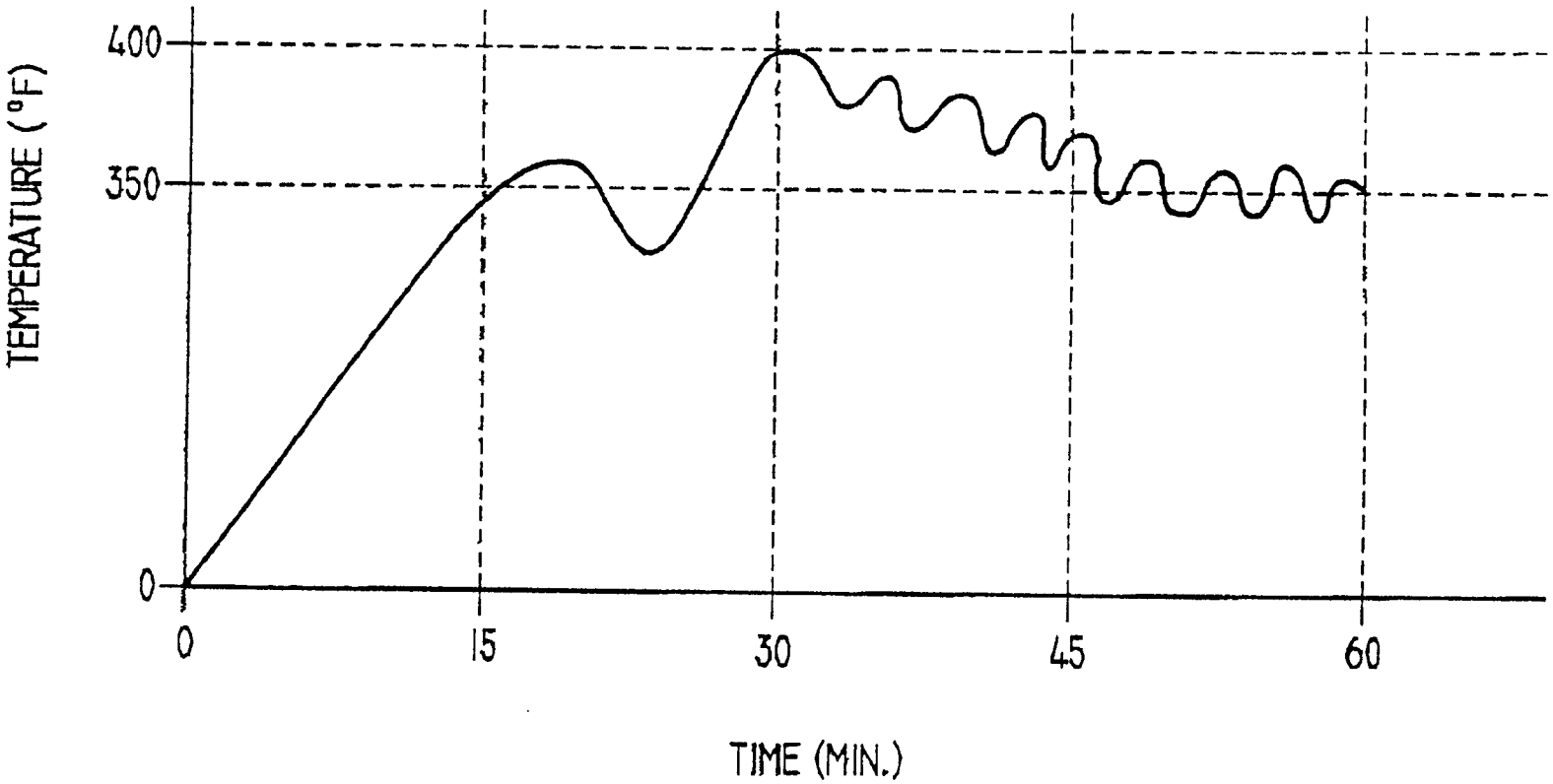
FIG. 3 is a graphical representation of the temperature of the oven cavity when heated in accordance with the invention.

To this end, FIG. 3 represents a time/temperature curve associated with the use of oven cavity 8 in cooking a food item for 60 minutes at 350° F. That is, the food has already been placed in oven cavity 8 and a cooking operation for 350° F. for 60 minutes has been programmed. Depending on the food load, oven cavity 8 will reach the set temperature in a certain period of time, say 15 minutes. CPU 75, in combination with cold start circuit 78, would then establish a peak temperature to be reached in oven cavity 8. In the example shown, this peak or overshoot temperature equals 50° F. above the 350° F., i.e., 400° F. The cooking operation would then proceed to reduce this temperature down to the programmed temperature over a portion of the overall cooking operation, with this portion being equal to ¼ or 15 minutes in the example provided. The remaining time in the overall cooking operation would be at the programmed 350° F. temperature. Of course, due to the activation/deactivation periods of the heat source(s) 9, 14, the actual temperature in oven cavity will fluctuate about this set temperature as clearly represented in FIG. 3.

Although described with reference to a preferred embodiment of the invention, it should be readily understood that various changes and/or modifications can be made to the invention without departing from the spirit thereof. For instance, even though the invention has been described as employing a special button on the control panel for the cooking appliance to establish the cold start cooking sequence, other control arrangements could be equally employed, including the activation of two or more other buttons simultaneously. In addition, although the invention has been described in connection with an electric cooking appliance, the invention could be employed in a wide range of cooking appliances, including gas and/or convection ovens, including those also incorporating microwave or other heat sources. Of course, control panel 28 can take various forms and configurations in accordance with the invention. Furthermore, it should be recognized that the line in FIG. 3 only represents a typical temperature progression in accordance with the invention, and that a variety of other graphs may result. In general, the invention is only intended to be limited by the scope of the following claims.

I claim:

1. A cooking appliance incorporating a cold start cooking mode comprising:

an oven cavity;

at least one heating element disposed inside said oven cavity;

a control panel including a plurality of input members for programming at least time and temperature parameters for a cooking operation within the oven cavity and for selectively establishing a cold start cooking mode for the cooking appliance; and means for controlling said at least one heating element in accordance with a cold start cooking sequence upon establishing the cold start cooking mode, said controlling means being adapted to alter at least one of the time and temperature parameters programmed for the cooking operation in order to compensate for a lack of preheating of the oven cavity.

2. The cooking appliance according to claim 1, wherein the plurality of input members includes a selector member dedicated for use in establishing the cold start cooking mode.

3. The cooking appliance according to claim 1, wherein the controlling means operates said at least one heating element so as to initially elevate said oven cavity to a temperature above the programmed temperature parameter and then to subsequently reduce the oven cavity towards the programmed temperature parameter.

4. The cooking appliance according to claim 3, wherein the controlling means establishes an actual cook time which is greater than the programmed time parameter.

5. The cooking appliance according to claim 1, wherein the controlling means establishes an actual cook time which is greater than the programmed time parameter.

6. The cooking appliance according to claim 5, wherein the controlling means establishes the actual cook time depending upon a food load placed in the oven cavity for the cooking operation.

7. The cooking appliance according to claim 1, further comprising: a fan exposed to the oven cavity, wherein said controlling means is further adapted to operate said fan to control a temperature in said oven cavity.

8. A cooking appliance incorporating a cold start cooking mode comprising:

an oven cavity;

at least one heating element disposed inside said oven cavity; a control panel including a plurality of input members for programming at least time and temperature parameters for a cooking operation within the oven cavity and a dedicated cold start selector member; and a controller for operating the at least one heating element in a first mode, wherein the cooking operation is performed based on the programmed time and temperature parameters and with preheating of the oven cavity, and a cold start cooking mode, wherein at least one of the programmed time and temperature parameters is automatically adjusted to alter the cooking operation in order to compensate for a lack of preheating of the oven cavity, said cold start cooking mode being established upon activation of the cold start selector member.

9. The cooking appliance according to claim 8, wherein the controller regulates the at least one heating element to initially elevate said oven cavity to a temperature above the programmed temperature parameter and then to subsequently reduce the oven cavity towards the programmed temperature parameter in the cold start cooking mode.

10. The cooking appliance according to claim 9, wherein the controller establishes an actual cook time which is greater than the programmed time parameter when the cold start cooking mode is selected.

11. The cooking appliance according to claim 8, wherein the controller establishes an actual cook time which is greater than the programmed time parameter when the cold start cooking mode is selected.

12. The cooking appliance according to claim 11, wherein the controller establishes the actual cook time depending upon a food load placed in the oven cavity for the cooking operation.

13. The cooking appliance according to claim 8, further comprising: a fan exposed to the oven cavity, wherein said controller is further adapted to operate said fan to control a temperature in said oven cavity.

14. In a cooking appliance including an oven cavity, at least one heating element disposed inside said oven cavity, and a control panel having a plurality of input members for programming a time and temperature parameters, as well as selecting a cold start cooking mode, for a cooking operation within the oven cavity, a method of performing the cooking operation without preheating the oven cavity comprising:

A) inputting time and temperature parameters for a cooking operation;

B) selectively establishing a cold start cooking mode of operation;

C) elevating said oven cavity to a first temperature above the temperature parameter programmed for the cooking operation;

D) reducing said oven cavity to a second temperature which is substantially below the first temperature; and E) substantially maintaining the second temperature for a determined period of time, with at least one of the second temperature and the determined period of time being different than the time and temperature parameters so as to compensate for not pre-heating the oven cavity in the cold start mode.

15. The method of claim 14, wherein the cooking operation is performed for an actual cook time which is greater than the programmed time parameter.

16. The method of claim 15, further comprising: establishing the actual cook time based upon a food load placed in the oven cavity for the cooking operation.

17. The method of claim 14, further comprising: selecting the cooking operation without a preheating of the oven cavity through a dedicated cold start selector member provided on the control panel.

18. The method of claim 14, further comprising: operating a fan to distribute air within said oven cavity during at least a portion of the cooking operation.

* * * * *